US006692573B1

(12) United States Patent
Jardin

(10) Patent No.: US 6,692,573 B1
(45) Date of Patent: Feb. 17, 2004

(54) AUTOMATED PITCH BUTTON DISPENSING STATION AND METHOD

(75) Inventor: Richard Des Jardin, Scotts Valley, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 385 days.

(21) Appl. No.: 09/586,180

(22) Filed: Jun. 1, 2000

(51) Int. Cl.[7] ..... B05C 11/10

(52) U.S. Cl. ..... 118/697; 118/704; 118/696; 118/320; 118/323

(58) Field of Search ..... 118/696, 321, 118/323, 305, 500, 256, 697, 704; 156/350, 356, 357

(56) References Cited

U.S. PATENT DOCUMENTS 4,868,007 A * 9/1989 Taguchi ..... 118/696
5,303,141 A * 4/1994 Batchelder et al. .... 156/244.11
5,340,433 A * 8/1994 Crump ..... 118/202
5,534,101 A * 7/1996 Keyworth et al. ..... 156/244.12
6,050,314 A * 4/2000 Kakishima et al. ..... 118/256
6,401,001 B1 * 6/2002 Jang et al. ..... 700/118

OTHER PUBLICATIONS

Definition of "acrylic resin", Webster's II New Riverside Dictionary, 1984, 1988, 1994, Houghton Mifflin Company, p. 750.*

Norland Products Material Safety Data Sheet NOA 68, date prepared, 1991, revised, Aug. 15, 1996, 3 pages, published by Norlan Products Incorporated.*

* cited by examiner

*Primary Examiner*—Richard Crispino
*Assistant Examiner*—George R. Koch, III

(57) ABSTRACT

The present invention provides a work station and method for applying a blocking material such as pitch or the like to a selected location on a workpiece or workpieces, wherein the work station includes an automated blocking material dispenser, an X-Y stage for positioning the workpiece(s) and a microprocessor, and wherein the method includes the synchronized operation of the X-Y stage and the dispenser under control of the microprocessor to deposit a selected amount and shape of the blocking material in a selected location or locations on a workpiece or workpieces with a high degree of repeatability in a short cycle time.

17 Claims, 4 Drawing Sheets

AUTOMATED PITCH BUTTON DISPENSING STATION AND METHOD

BACKGROUND

The present invention relates to manufacturing equipment and methods, particularly equipment and procedures which may be involved in the making of optical items, such as polarizing beam splitter ("PBS") prism assemblies, for use in, for example, interferometers and other optical products. More particularly, the present invention relates to blocking technology, i.e., holding or supporting technology, for holding prisms or other optical workpieces or items in a selected position for performing work on them efficiently, with precision, and without inducing strain that could deform them.

Blocking or supporting optical elements is known in the manufacture and treatment of high precision optics and optical items such as prisms, mirrors, lenses, windows and the like. One method of blocking may involve a blocking tool and the use of pitch "buttons." The buttons comprise deposits of blocking pitch, usually in the form of small discs, which are applied to a surface or surfaces of the optic being blocked or supported. The pitch button size, form factor, location on the optic surface and adherent qualities are variables which may affect the blocking process.

Currently, pitch button blocking is done by hand, using trained experts who apply a selected number of buttons, of a selected size, to a selected location or locations on a workpiece. The process is very time consuming and requires highly trained operators and experts, and thus is currently labor intensive. Even using trained technicians, it typically takes one to two days to "button" a set of prisms using the traditional, known methods.

Another problem is that, although experts are used, the consistency of the button size and layout location could be improved. In fact, the button-to-button volume variation using traditional methods is typically greater than 60%.

Clearly, there is need for an automated apparatus and method of dispensing pitch buttons to reduce the labor involved, to reduce the need for "expert" technicians, to shorten the pitch buttoning cycle time and to increase the consistency and repeatability of the pitch button size and layout location.

SUMMARY

The present invention provides an apparatus or system and method for dispensing or applying a selected amount of supporting or holding material to a selected location on a workpiece.

In one embodiment, the present invention provides a work station and method for applying a blocking material, such as pitch or the like, to a selected location on a workpiece, wherein the work station includes an automated blocking material dispenser, a positioning stage for positioning the workpiece and a microprocessor, and wherein the method includes the synchronized and complimentary operation of the positioning stage and the dispenser under control of the microprocessor to deposit a selected amount and shape of the blocking material in a selected location or locations on a workpiece or workpieces with a high degree of repeatability in a short cycle time.

In another embodiment, the present invention provides a work station comprising an automated pitch dispenser for dispensing or applying one or more pitch buttons to a workpiece or workpieces, and a positioning stage for positioning the workpiece(s), wherein the dispenser and positioning stage are coordinately operated and controlled by a suitable computer or microprocessor and software. The work station may include appropriate peripheral devices and apparatus such as a preheating oven, sensing or process monitoring devices, and workpiece carriers and/or tool holders.

In one embodiment, the method of use or operation of the pitch button station of the present invention comprises the positioning stage, for example an X-Y stage, moving or positioning a workpiece or workpieces, such as pre-heated optics, relative to a pitch dispenser, and the dispenser depositing pitch buttons on the positioned workpiece(s). In this embodiment, wherein the pitch dispenser and the X-Y stage are controlled by a computer and appropriate software or program(s), the buttons are positioned at precise, selected positions, in a precise selected size, in a very short cycle time, and with a high degree of repeatability.

An advantage of the present invention is that it speeds the "buttoning" process from the typical one to two days to button a set of prisms using known methods to about an hour.

Another advantage of the present invention is that button volume variants are expected to decrease to less than 8%. This is advantageous because it creates greater process consistency, resulting in reduced polishing time and better flatness control of the optics.

Advantageously, the pitch button apparatus and method of the present invention will help reduce manufacturing costs and new product introduction costs by using a continuous process. It will further the goal of developing manufacturing processes which enable fast response to market needs. It will facilitate the development of high and consistent yields of optics, reduce process variability, and provide for the easier, more accurate monitoring and accumulation of cost and quality information and management.

Additional advantages of automating pitch button blocking in accordance with the present invention include shortening lead time, removing the need for as many experts in the buttoning process, allowing achievement of better flatness control, increasing yields through greater blocking process consistency and supporting production goals, particularly as regards certain optics, such as 1 inch, 2 inch×1 inch, and 4 inch×1 inch prisms, from a common blank and fabrication process. In particular, the apparatus and method of the present invention saves money and provides for increased production levels.

In one embodiment, the pitch button dispensing station of the present invention is a customized work station which automatically deposits pitch buttons on prisms.

The pitch button dispensing station system or assembly of the present invention may be incorporated conveniently into current manufacturing lines and/or facilities, and it may be adapted or configured to improve and/or conform to a particular material flow.

Other features and advantages of the automated pitch button dispensing apparatus and method of the present invention will become more fully apparent and understood with reference to the following description and appended drawings and claims.

DETAILED DESCRIPTION

Figure 1:
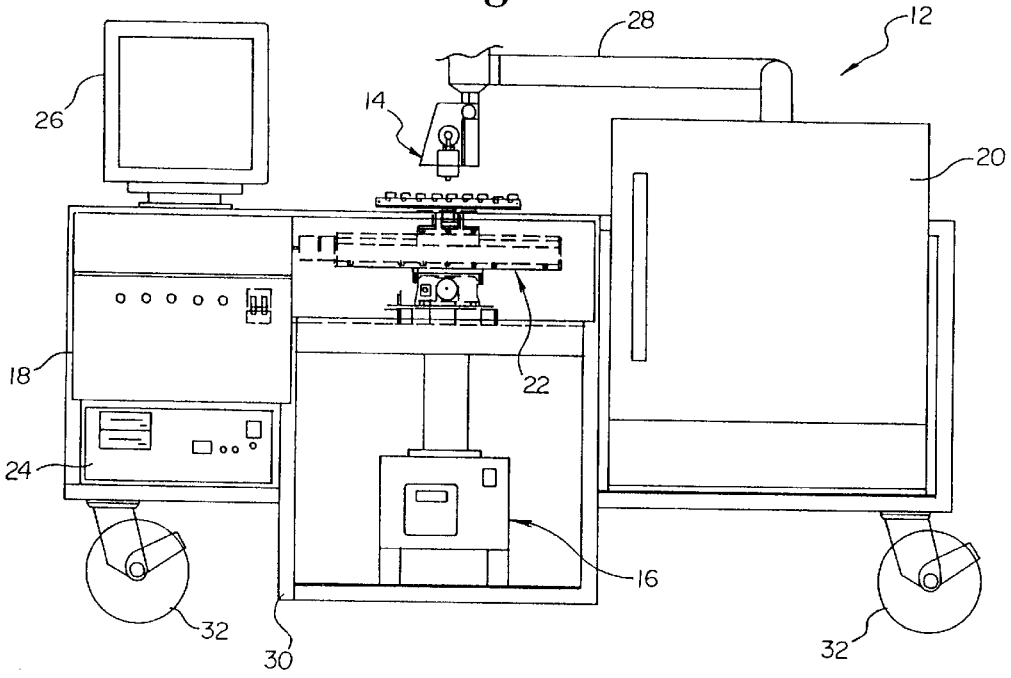
FIG. 1 is a front elevational view of one embodiment of the pitch button dispensing station in accordance with the present invention.

The accompanying Figures and this description depict and describe embodiments of a automated work station and method for applying a blocking material, such as pitch or the like, to a selected location on a workpiece, for example, an optic, wherein the work station includes an automated blocking material dispenser, a positioning stage for positioning the workpiece and a microprocessor, and wherein the method includes the synchronized and complimentary operation of the positioning stage and the dispenser under control of the microprocessor to deposit a selected amount and shape of the blocking material in a selected location or locations on a workpiece. As used herein the term "station" is intended to encompass an area or location of operations, and apparatus at or in the area or location for performing operations. As used herein the term "pitch" is intended to encompass any material suitable for use in blocking, i.e., holding and supporting, operations, including viscous substances typically obtained as a residue in the distillation of organic materials, bituminous substances, resinous substances, artificial mixtures resembling resinous or bituminous pitches and the like. With regard to means and devices for fastening, mounting, coupling, attaching or connecting components of the present invention to form the apparatus and system as a whole, unless specifically described otherwise, such means and devices are intended to encompass conventional fasteners such as machine screws, nut and bolt type connectors, snap rings, clamps such as hose clamps, screw clamps and the like, rivets, toggles, pins and the like. Components may also be connected by adhesives, glues, welding, ultrasonic welding, and friction fitting or deformation, if appropriate. Other fastening or attachment devices or methods such as soldering may be used as well, particularly with regard to the electrical system of the apparatus. All components of the electrical system and/or wiring harness or connections of the present invention may be conventionally, operably linked conventional commercially available components, unless otherwise indicated, including electrical components (e.g., switches, fuses, lights, connectors, etc.) and circuitry, wires, soldered connections, inputs, chips, boards and display and/or control system components.

Generally, unless specifically otherwise disclosed or taught, materials for making, assembling or coupling components of the present invention may be selected from appropriate materials such as metal, metallic alloys, ceramics, plastics, glasses and the like. Appropriate manufacturing or production methods including casting, pressing, extruding, molding and machining may be used.

Any references to front and back, right and left, top and bottom, and upper and lower are intended for convenience of description, not to limit the present invention or its components to any one positional or spacial orientation.

This detailed description is intended to be read and understood in conjunction with Appendix A which is incorporated herein by reference. Appendix A provides one sequence of operations of the method of the present invention.

Referring then to the Figures, particularly FIG. 1, the pitch button dispensing and applying station or apparatus 12 in accordance with the present invention comprises a pitch button applicator 14, a hot melt unit 16, a control panel 18, a pre-heating oven 20, an X-Y stage 22, a computer 24, incorporating and/or having access to a suitable data storage medium, and a monitor 26. An exhaust system 28, including a hood and conduit coupled to a suitable flow inducing device (not shown), may be provided to handle any heat and fumes produced during use of the apparatus 12. As shown in FIG. 1, the components of the apparatus 12 may be mounted on a suitable frame 30, and the frame 30 may be provided with an appropriate number of wheels or casters 32.

Figure 2:
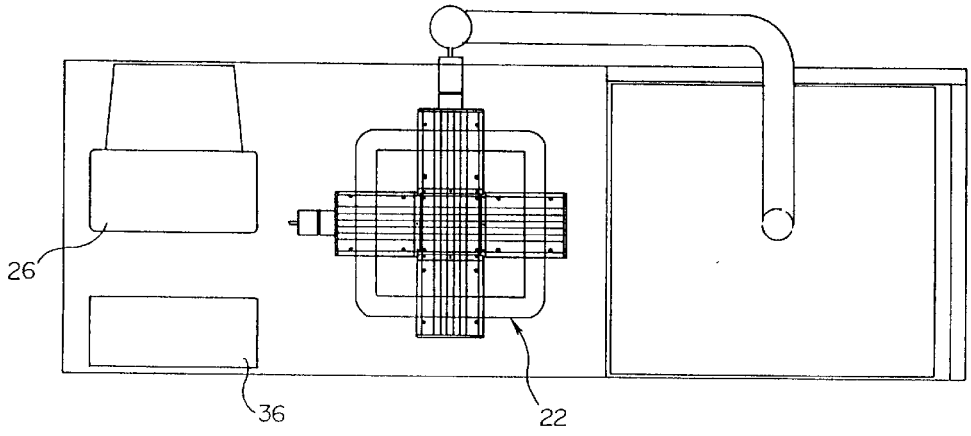
FIG. 2 is a top plan view of the embodiment depicted in FIG. 1.

Referring to FIG. 2, an input keyboard 36 may be suitably located adjacent the monitor 26 to provide convenient input or control of the process of the present invention.

Figure 3:
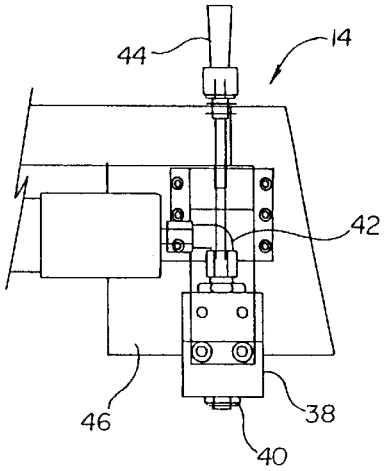
FIG. 3 is a side elevational view, partially in cross-section, of the dispenser head of the embodiment depicted in FIG. 1.
Figure 4:
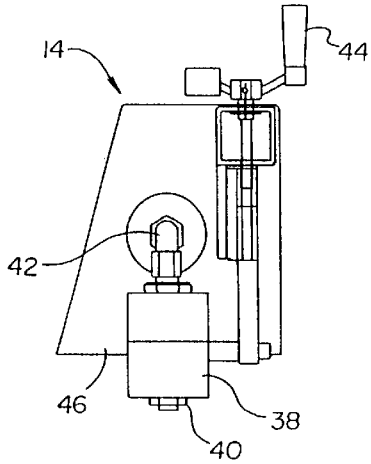
FIG. 4 is a front elevational view, partially in cross-section, of the dispenser head.

Additional details of the applicator 14, particularly the pitch button dispensing head 38 thereof, are depicted in FIGS. 3 and 4. The pitch button dispensing head 38 includes an applicator tip 40 coupled by a suitable conduit 42 to a pitch supply, typically in the hot melt unit 16, a height adjustment crank 44, and the exhaust hood 46 which is coupled to the exhaust system 28.

Figure 5:
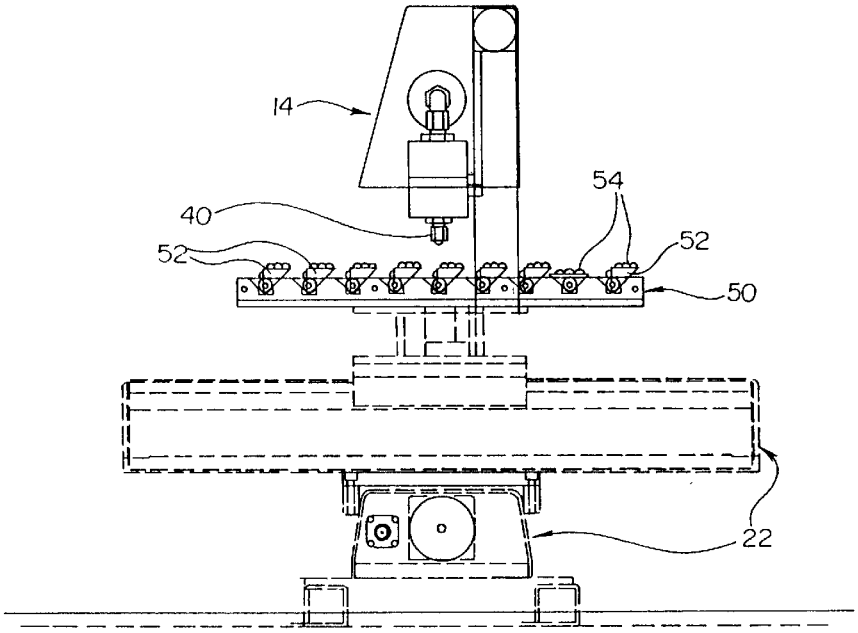
FIG. 5 is a front elevational view, partially in cross-section, of the embodiment depicted is FIG. 1.

Referring to FIG. 5, the generally spaced, parallel relationship between the X-Y stage 22 and the applicator 14, particularly the applicator tip 40, is depicted, along with a loaded parts tray 50, the tray 50 being depicted as loaded or containing a plurality of one-inch prisms 52, each "buttoned" with pitch buttons 54.

Operation

In use, the pitch button blocking station 12 of the present invention is used by turning on the main power switch, which may be suitably located on the front control panel 18, along with other controls, inputs and suitable operational indicators, such as "power-on" indicators or lights. The operator should check that the power is on to the pitch melt unit 16 and to the oven 20. The oven 20 and pitch in the hot melt unit 16 should be allowed to heat for approximately 30 minutes before placing any substrates (i.e., workpieces) into the oven 20. Next, substrates, e.g., prisms, mirrors or other optics, are loaded on to a parts tray 50. A layer of photocopy paper (not shown) may be used between the substrates on the parts tray 50 to avoid scratching the substrates and to protect the parts tray 50 from pitch. One general loading pattern for substrates is flush to the left side and rear of the parts tray 50, but other arrangements may be used. Typically, a parts tray 50 has a front portion with an edge or side wall with a bar containing adjustable set screw stops for positioning and securing workpieces. Substrates loaded in parts trays 50 generally as outlined are depicted in FIGS. 7–11, and described below. The loaded parts trays 50 may be placed in the pre-heat oven 20 for a selected period of time depending on the substrate, in the instance of certain prisms, for about one to two hours.

Next, a "clean-out run" is made prior to removing the heated parts tray 50 from the oven 20. The clean-out run comprises running a program similar to other pitch buttoning process programs, except it may not involve moving the X-Y stage 22. The purpose of the clean-out run is to clean out old pitch from the pitch dispenser 14 and applicator tip 40. A suitable container should be placed directly beneath the applicator tip 40 to catch any old pitch dispensed. The applicator tip 40 is heated during the clean-out run, and may be cleaned with appropriate materials, e.g., a Q-tip or the like and acetone or another appropriate solvent, to help control or limit pitch tails which might otherwise occur during the buttoning process.

A parts tray 50 is removed from the oven 20 and installed on locating or positioning devices, such as pins, posts or pins receiving holes (not shown, but typical), provided on the X-Y stage 22. Suitable means for holding the parts tray 50 in place, e.g., an electromagnetic system or a mechanical system, is actuated.

Next, a vertical clearance, e.g., approximately 0.17 to 0.26 inch, between the applicator tip 40 at the bottom of the dispensing head 14 and the substrates loaded on the parts tray 50 may be selected. Vertical height adjustment of the applicator tip 40 may be achieved by turning the crank handle 44, but other height adjustment means, such as a stepper motor and belt or screw arrangement may used as well. In the instance of the mechanical crank height adjustment system 44, clockwise is up and counterclockwise is down.

Next, the pitch pump (not shown, but which may be coupled to or a component of the hot melt unit 16) should be turned on at the control panel and a selected, appropriate motion architect software should be actuated. Once the motion program is selected, it may be communicated or sent, and actuated. An operator should watch the program run, i.e., the buttons being placed, for at least several minutes. An emergency stop may be provided to halt the program. After the last substrate has been buttoned, the pitch pump should be turned off immediately while the program is allowed to finish. After the program has finished, all X-Y stage motion will stop and the substrates may be removed. The motion program should be dismissed by selecting an appropriate menu command, and the main power switch may be turned off.

The pitch button station 12 described herein may have default settings which have been synchronized to work together. These settings, which are intended to be exemplary, will yield a pitch button of approximately 0.3 inches in diameter by 0.12 inches thick, which will adhere to a substrate preheated to approximately 60 degrees centigrade and then cooled slightly (approximately less than 15 minutes). The following exemplary default settings may be varied, but for the exemplary programs or operations set forth herein, should not be changed without explicit prearrangement.

| | |
|---|---|
| Tank | 220 degrees F |
| Hose | 230 degrees F |
| Head | 240 degrees F |
| Oven | 60 Degrees C |
| Pump | 2¼ full turns from a closed position |

-continued

| | |
|---|---|
| Scale | 125000 steps per linear inch |
| Var1 = 0 | set variable 1 to 0 |
| Var2 = 0.2 | set variable 2 to 0.2 |
| Var3 = 0.11 | set variable 3 to 0.1 |
| Hom5,5 | set stage velocity to 5 |

With respect to the X-Y stage 22, the stage commands are set forth, explained and listed in the "Compumotor 600 Series Software Reference" (Parker Hannifin Corp. P/N 88-012966-01), which is incorporated herein by reference. Stage programming information is contained in the "Compumotor 600 Series Programer's Guide" (Parker Hannifin Corp. P/N 88-014540-01), which is incorporated herein by reference.

With respect to the hot melt unit 16 and its operational commands, such may be found in the "Slautterback Service Manual" (Slautterback Loose Leaf Binder, Order No. C262711, Model Name KB10,200-230VT500, Schematic Numbers 19610, 034012601, Dec. 3, 1997), which are incorporated herein by reference.

Figure 6:
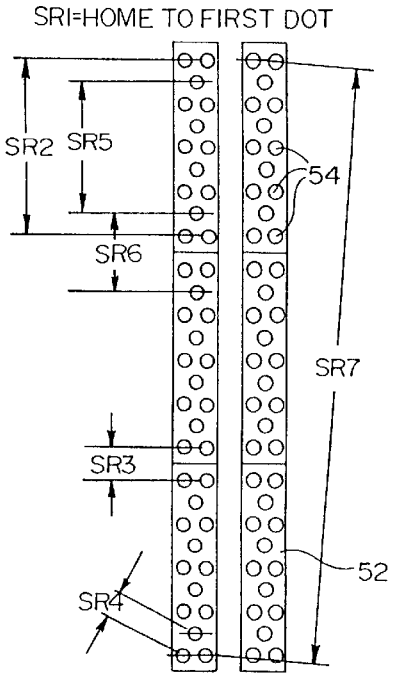
FIG. 6 depicts the one operational effect or result of the pitch button station and method of the present invention.

The way one program works is set forth in Appendix A. Each of the noted subroutines defines a particular pitch button pattern which may be varied as desired. Building or combining several of these and/or altering the order in which they are called places a desired overall pitch button pattern on substrates mounted in a parts tray. For instance, referring to FIG. 6, a substantially representational depiction, RS1 defines the jump from the home position to the first dot position (beginning of SR2). SR2 defines the pitch button pattern for the first row of buttons, as shown. SR3 defines the jump from the last button of one substrate in the first row of buttons to the first button of the next substrate in that row, as shown. RS4 defines the jump from the last button of the first row to the first button of the second row of buttons, as shown. SR5 defines the pitch button pattern for the second row of buttons, as shown. SR6 defines the jump from the last button of one substrate in the second row of buttons to the first button of the next substrate in that row, as shown. SR7 defines the jump from the last button of the last row of the buttons in the first row of substrates to the first button of the first row of button on the second row of substrates, as shown.

Figure 7:
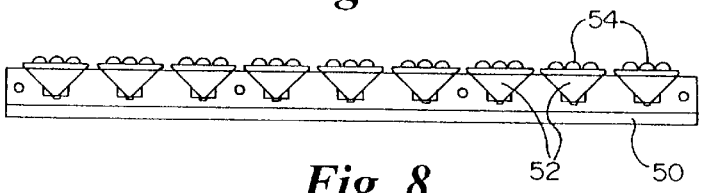
FIG. 7 is a front elevational of another operational effect or result of the pitch button station and method of the present invention.
Figure 8:
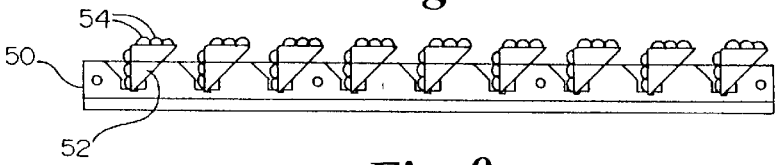
FIG. 8 is a front elevational of another operational effect or result of the pitch button station and method of the present invention.
Figure 9:
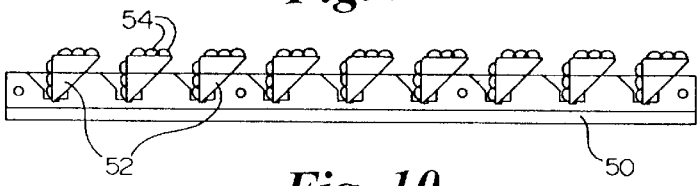
FIG. 9 is a front elevational of another operational effect or result of the pitch button station and method of the present invention.
Figure 10:
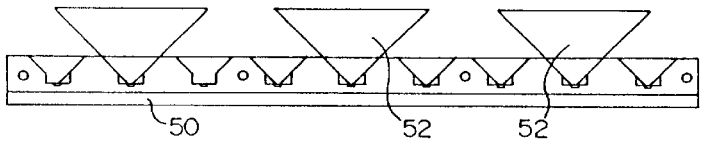
FIG. 10 is a front elevational of another operational effect or result of the pitch button station and method of the present invention.
Figure 11:
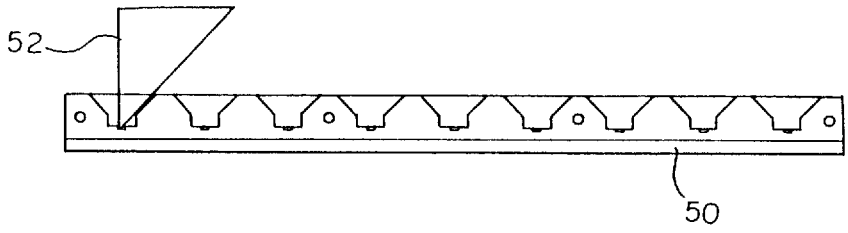
FIG. 11 depicts patterning and prisms on a tray.

Referring to FIGS. 7–11, various patterns of loading of optics on parts trays 50, 50' are depicted. A selected program, generally of the type set forth in Appendix A, will correspond to the depicted loading; however, custom designed loading patterns and programs are encompassed by the present invention. Each of the Figures provides an elevational sectional view of substrates loaded on a parts tray 50. The parts tray 50, which is intended to representative of such trays, has a plurality of optic receiving rails or supports 51. Generally, for this type of tray 50, the loading pattern is to set the optics 52 flush to each other and to the back stop or end of each column, and on the parts tray 50 as depicted in the FIGS. 7–11. In FIG. 7, prisms 52 are depicted loaded or positioned on a parts tray 50 in a position wherein pitch buttons 54 are deposited on the hypothenuse of a prism 52 to facilitate polishing the legs in a subsequent part of the manufacturing process. In FIG. 8, a loading pattern similar to that depicted in FIG. 7 is shown, but pitch buttons 54 are depicted on the legs of the prisms 52 to enable the subsequent polishing of the hypothenuse. FIG. 9 is generally similar, but for a different optic or prism. FIG. 10 depicts another prism configuration positioned on a parts tray 50 to receive pitch on the hypothenuse to enable subsequent polishing of the legs, and FIG. 11 depicts patterning and positioning of prisms on a tray 50 to deposit pitch on the legs so the hypotenuse may be polished.

Figure 12:
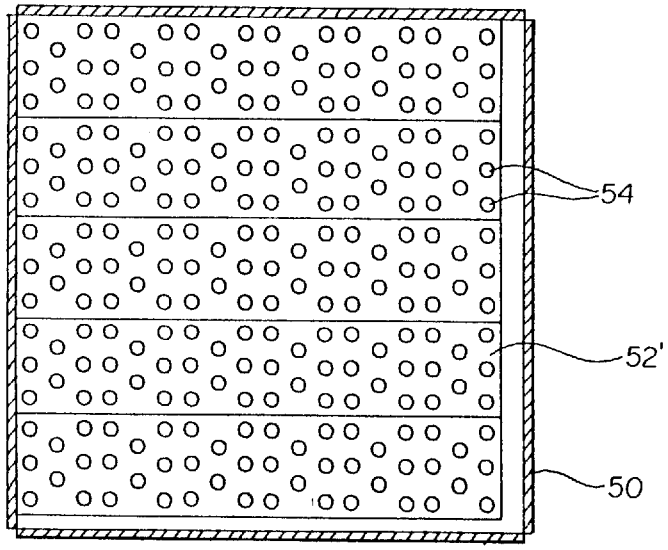
FIG. 12 depicts a parts tray.

FIG. 12 depicts a parts tray 50' that does not have optic supporting rails. The loading pattern for this tray 50' is to set the optics flush to each other in both directions and to the back and left sides of the tray 50', with the longer direction (if the otic is rectangular) aligned with the front-back direction of the parts tray 50' and the pitch button station 12. The optic(s) 52 depicted in FIG. 12 is a large reference mirror 52'.

Alternative Embodiments

Alternative embodiments of the pitch button station 12 of the present invention may be configured as desired. For example, a multiple or three-axis (i.e., X, Y, Z axes) positioning stage may be used in place of the X-Y (i.e., dual) stage 22. Interchangeable applicator tips may used to additionally control, shape or regulate the dispensing of pitch and the size and shape of pitch buttons. The station may include an modified, expanded or relocated staging area, or a staging platform designed to accommodate a particular parts tray 50. Suitable shelving or conveying means may be incorporated, and a freezer or cooler may be adjacent or incorporated for cooling purposes. Storage cabinets or racks may be provided or integrated as well. In some embodiments of the present invention, suitable microprocessor, computer and peripheral equipment, including sensors for monitoring the process of the present invention, and/or additional microprocessors, may be incorporated. The microprocessor, for example a suitable pc, or microprocessors, may be programed and/or provided with a suitable data storage medium to accomplish blocking of virtually any selected optic or prism, or numbers thereof.

The present invention may be embodied in other specific forms and/or steps without departing from the essential spirit or attributes thereof. The described embodiment should be considered in all respects as illustrative, not restrictive.

APPENDIX A

Exemplary Program:

Programming Note: Care needs to be exerted to keep the program modules consistent and of
the same style, so as to ease the programming and debugging phase.

Title Block

The first section of the program, the title block, is a description of the program name, the optics involved, and the version (date last edited).

HP3.PRG.
Pitch buttons on prism leg to polish hypo; 1 x 4.5" long prisms
produced by
Hewlett Packard -rpd, last edited 09-17-98

Setup Block

The next section of the program, the setup block, is a lengthy boilerplate enumerating the various Compumotor command definitions. These commands do not change from program to program.

Setup Program for the AT6200 Indexer
produced by
Motion Architect (R) Setup , Version 3.5

AXIS SCALING

| | |
|---|---|
| SCALE 1 | Enable acceleration, distance and velocity scale factors |
| SCLA 25000, 25000 | Acceleration = steps/rev, steps/rev |
| SCLD 1, 1 | Distance = steps/step, steps/step |
| SCLV 25000, 25000 | Velocity = steps/rev, steps/rev |

DEFINE SETUP PROGRAM

| | |
|---|---|
| DEL setup | Delete program, if any |
| DEF setup | Begin definition of program |

AXIS SCALING

| | |
|---|---|
| SCALE 1 | Enable acceleration, distance and velocity scale factors |
| SCLA 25000, 25000 | Acceleration = steps/rev, steps/rev |
| SCLD 1, 1 | Distance = steps/step, steps/step |
| SCLV 25000, −25000 | Velocity = steps/rev, steps/rev |

PARTICIPATING AXES

| | |
|---|---|
| INDAX 2 | Specify number of participating axes |

STEP PULSE

| | |
|---|---|
| PULSE 0.3, 0.3 | Specify step output pulse width |

DRIVES

| | |
|---|---|
| DRES 25000, 25000 | Match Indexer resolution to drive resolution (steps/rev) |
| DRFLVL 00 | Define the active state of each drive fault input |
| INFEN 1 | Enable/disable drive fault input and input functions (INFNC) |

HARD LIMITS

| | |
|---|---|
| LH 3, 3 | Enable/disable hard end-of-travel limits |
| LHAD 100, 100 | Specify hard limit deceleration (units/sec/sec) |
| LHLVL 0000 | Define the active state of each hard limit |

APPENDIX A-continued

| | |
|---|---|
| | SOFT LIMITS |
| LSCW 0, 0 | Specify soft limit POS (CW) range (units) |
| LSCCW 0, 0 | Specify soft limit NEO (CCW) range (units) |
| LS 0, 0 | Enable/disable soft limits |
| LSAD 100, 100 | Specify soft limit deceleration (units/sec/sec) |
| | HOME LIMITS |
| HOMA 10, 10 | Specify home acceleration (units/sec/sec) |
| HOMAD 10, 10 | Specify home deceleration (units/sec/sec) |
| HOMBAC 00 | Enable/disable home backup operation |
| HOMEDG 00 | Specify home reference edge - POS/NEG (CW/CCW) |
| HOMDF 00 | Specify home final direction POS/NEG. (CW/CCW) |
| HOMZ 00 | Enable/disable Z-channel homing |
| HOMLVL 00 | Define the active state of each home limit |
| HOM 10, 10 | Specify home velocity (units/sec) |
| HOMVF 10, 10 | Specify home final velocity (units/sec) |
| | OUTPUTS |
| OUTFEN 0 | Enable/disable output functions (OUTFNC) |
| OUTLVL 0 | Define the active state of each programmable output |
| OUTFNC 1-A | Define programmable output |
| OUTFNC 2-A | Define programmable output |
| OUTFNC 3-A | Define programmable output |
| OUTFNC 4-A | Define programmable output |
| OUTFNC 5-A | Define programmable output |
| OUTFNC 6-A | Define programmable output |
| OUTFNC 7-A | Define programmable output |
| OUTFNC 8-A | Define programmable output |
| OUTFNC 9-A | Define programmable output |
| OUTFNC 10-A | Define programmable output |
| OUTFNC 11-A | Define programmable output |
| OUTFNC 12-A | Define programmable output |
| OUTFNC 13-A | Define programmable output |
| OUTFNC 14-A | Define programmable output |
| OUTFNC 15-A | Define programmable output |
| OUTFNC 16-A | Define programmable output |
| OUTFNC 17-A | Define programmable output |
| OUTFNC 18-A | Define programmable output |
| OUTFNC 19-A | Define programmable output |
| OUTFNC 20-A | Define programmable output |
| OUTFNC 21-A | Define programmable output |
| OUTFNC 22-A | Define programmable output |
| OUTFNC 23-A | Define programmable output |
| OUTFNC 24-A | Define programmable output |
| | INPUTS & TRIGGERS |
| INFEN 1 | Enable/disable drive fault input and input functions (INFNC) |
| INLVL 00 | Define the active state of each programmable input |
| INFNC 1-OP | Define program-select input |
| INFNC 2-OP | Define program-select input |
| INFNC 3-OP | Define program-select input |
| INFNC 4-A | Define programmable input |
| INFNC 5-A | Define programmable input |
| INFNC 6-A | Define programmable input |
| INFNC 7-A | Define programmable input |
| INENC 8-A | Define programmable input |
| INFNC 9-A | Define programmable input |
| INFNC 10-A | Define programmable input |
| INFNC 11-A | Define programmable input |
| INFNC 12-A | Define programmable input |
| IMENC 13-A | Define programmable input |
| INFNC 14-A | Define programmable input |
| INFNC 15-A | Define programmable input |
| INFNC 16-A | Define programmable input |
| INFNC 17-A | Define programmable input |
| INFNC 18-A | Define programmable input |
| INFNC 19-A | Define programmable input |
| INFNC 20-A | Define programmable input |
| INFNC 21-A | Define programmable input |
| INFNC 22-A | Define programmable input |
| INFNC 23-A | Define programmable input |
| INFNC 24-A | Define programmable input |
| | JOG |
| JOG 00 | Enable/disable jog mode |
| JOGA 10, 10 | Specify jog acceleration (units/sec/sec) |
| JOGAD 10, 10 | Specify jog deceleration (units/sec/sec) |

APPENDIX A-continued

| | |
|---|---|
| JOGVH 10, 10 | Specify jog velocity (units/sec) when the jog velocity select input is high |
| JOGVL 0.5, 0.5 | Specify jog velocity (units#sec) when the jog velocity select input is low |
| | PROGRAM SELECTION |
| INSELP 0.0 | Enable/disable program selection by inputs |
| | END SETUP PROGRAM |
| END | End program definition |
| | Subroutine Block |

Next is a subroutine block of the program. This may change from program to program. In this block, the program name and subroutine names (& command structure) are defined. First, the program name (definition) itself is deleted and then reset (defined), as is each subsequent subroutine (sr).

Next the subroutine command structures are defined. An example of the subroutine command structure is given below.

Example:

| | |
|---|---|
| del sr2 | delete subroutine 2 |
| def sr2 | define subroutine 2 |
| $ sr2 | subroutine #2 heading (start) |
| var1 = 0 | set variable 1 to 0 |
| var2 = 0.2 | set variable 2 to 0.2 |
| var3 = 0.1 | set variable 3 to 0.1 |
| while (var1 < 4) | |
| var1=var1 + 1 | execute while instructions 3x (3 buttons) |
| d0,−120000 | |
| go01 | move X by 0 steps, move Y by −120000 steps |
| t(var2) | dwell time = 0.2 seconds(var2) |
| out.1 − 1 | first programmable output (pitch) on |
| t(var3) | dwell time = 0.1 seconds(var3) |
| out.1 − 0 | first programmable output (pitch) off |
| nwhile | next while |
| end | end of subroutine. |

Note: Do not change the var1, var2, or var3 settings, as they will change how the pitch is deposited, unless absolutely necessary for a special program. If this is done, be suere to add a comment section immediately next to the changed variable so that it is not inadvertently copied and used elsewhere.

What is claimed is:

1. An apparatus for applying a material to a workpiece at a selected location on the workpiece, the apparatus comprising:

an automated material dispenser, including:

a pitch supply, wherein the dispenser dispenses pitch from the pitch supply;

a positioning stage for positioning the workpiece; and, a microprocessor for controlling the dispenser and positioning stage.

2. The apparatus according to claim 1, wherein the positioning stage is an X-Y stage.

3. The apparatus according to claim 1, further comprising a height adjustor for selecting a generally vertical distance between the dispenser and the positioning stage.

4. The apparatus according to claim 3, wherein the material dispenser comprises an applicator and a hot melt unit.

5. The apparatus of claim 1, further comprising:

a data storage medium that includes a program stored on it, wherein the program includes instructions for depositing pitch buttons on a workpiece.

6. The apparatus according to claim 5, wherein the workpiece is an optic, and the instructions are for depositing pitch buttons on an optic.

7. The apparatus of claim 6, wherein the optic is a prism, and the instructions include instructions for depositing pitch buttons on a leg of the prism.

8. The apparatus of claim 6, wherein the optic is a prism, and the instructions include instructions for depositing pitch buttons on the hypotenuse of the prism.

9. The apparatus of claim 1, wherein the positioning stage is an X-Y-Z stage.

10. An automated work station for applying a blocking material, such as pitch, at a selected location on a selected number of workpieces, wherein the work station comprises:

a blocking material dispenser, including:

a pitch supply, wherein the dispenser dispenses pitch from the pitch supply;

a movable positioning stage for positioning the workpieces;

a processing unit for controlling the movement of the positioning stage and the dispensing of the dispenser; and, a data storage medium accessible by the processing unit, wherein the data storage medium has a program stored on it, and wherein in the program is configured to cause the processing unit to synchronize the movement of the positioning stage and the dispensing of the dispenser.

11. The automated work station according to claim 10, wherein the positioning stage is a two axis stage.

12. The automated work station of claim 10, wherein the program further includes instructions for depositing pitch buttons on a workpiece.

13. The automated work station of claim 12, wherein the workpiece is a prism, and the instructions include instructions for depositing pitch buttons on a leg of the prism.

14. The automated work station of claim 12, wherein the workpiece is a prism, and the instructions include instructions for depositing pitch buttons on the hypotenuse of the prism.

15. The automated work station of claim 10, wherein the positioning stage is an X-Y-Z stage.

16. An apparatus for applying a material to a workpiece at a selected location on the workpiece, the apparatus comprising:

an automated material dispenser;

a positioning stage for positioning the workpiece;

a microprocessor for controlling the dispenser and positioning stage; and a data storage medium that includes a program stored on it, wherein the program includes instructions for depositing pitch buttons on a workpiece.

17. An automated work station for applying a blocking material, such as pitch, at a selected location on a selected number of workpieces, wherein the work station comprises:

a blocking material dispenser;

a movable positioning stage for positioning the workpieces;

a processing unit for controlling the movement of the positioning stage and the dispensing of the dispenser; and a data storage medium accessible by the processing unit, wherein the data storage medium has a program stored on it and the program is configured to cause the processing unit to synchronize the movement of the positioning stage and the dispensing of the dispenser, the program including instructions for depositing pitch buttons on a workpiece.

* * * * *